US007011506B2

(12) United States Patent
Kim

(10) Patent No.: US 7,011,506 B2
(45) Date of Patent: Mar. 14, 2006

(54) BLOWER UNIT FOR AIR CONDITIONER

(75) Inventor: Jun Gyeong Kim, Daejeon (KR)

(73) Assignee: Halla Climate Control Corporation, Daejeon (KR)

( * ) Notice: Subject to any disclaimer, the term of this patent is extended or adjusted under 35 U.S.C. 154(b) by 341 days.

(21) Appl. No.: 10/434,287

(22) Filed: May 9, 2003

(65) Prior Publication Data

US 2003/0210981 A1 Nov. 13, 2003

(30) Foreign Application Priority Data

May 10, 2002 (KR) ..... 10-2002-0025906

(51) Int. Cl.
*F04B 17/03* (2006.01)

(52) U.S. Cl. ..... 417/366; 417/369

(58) Field of Classification Search ..... 417/370, 417/369, 366

See application file for complete search history.

(56) References Cited

U.S. PATENT DOCUMENTS 4,198,191 A * 4/1980 Pierce ..... 417/369
6,034,451 A * 3/2000 El Mayas ..... 310/63
6,802,699 B1 * 10/2004 Mikami et al. ..... 417/369

FOREIGN PATENT DOCUMENTS

JP 63-105466 7/1988
JP 7-28707 5/1995

* cited by examiner

*Primary Examiner*—Charles G. Freay
(74) *Attorney, Agent, or Firm*—Lowe, Hauptman & Berner, LLP

(57) ABSTRACT

A blower unit for an air conditioner includes a case accommodating a blower wheel and a blower motor driving the blower wheel, a cover coupled to one side of a lower portion of the case to form a cooling path so that some of cooling air blown by the blower wheel is input to the cooling path and flows in the cooling path toward a lower portion of the blower motor, and a coupling unit detachably coupling the cover and the case by sliding the cover in one direction with respect to the case.

9 Claims, 10 Drawing Sheets

BLOWER UNIT FOR AIR CONDITIONER

BACKGROUND OF THE INVENTION

This application claims the priority of Korean Patent Application No. 2002-25906 filed on 10 May 2002 in the Korean Intellectual Property Office, the disclosure of which is incorporated herein in its entirety by reference.

1. Field of the Invention

The present invention relates to a blower unit for an air conditioner, and more particularly, to a blower unit for an air conditioner which supplies air into the air conditioner.

2. Description of the Related Art

An air conditioner for a vehicle is to provide a pleasant condition by controlling temperature and humidity in the vehicle. According to its purpose, the air conditioner includes a cooling system to cool the inside the vehicle and a heating system to heat the inside the vehicle. The cooling system produces cool air by absorbing vaporization latent heat required for evaporation of coolant from air flowing around the evaporator while the coolant passes through the evaporator. The heating system produces hot air by inducing hot cooling water cooling an engine to flow into a heater core and heating air flowing around the heater core by the cooling water of the heater core. For this purpose, a typical air conditioner for a vehicle includes a blower unit for supplying air to the evaporator and/or heater core.

FIG. 1 is a sectional view illustrating a conventional blower unit which is disclosed in Japanese Utility Model Publication No. sho 63-105466. Referring to the drawing, a conventional blower unit 10 includes a case 11, a blower wheel 12 installed in the case 11, and a blower motor 13 connected to the blower wheel 12 and driving the blower wheel 12. A cooling path 11*a* through which some of cooling air blown by the blower wheel 12 passes is formed at one side in the case 11. A space for accommodating the blower motor 13 is formed in the lower portion of the case 11.

A cover 14 is coupled to one side of a lower portion of the case 11 to form a blow path 15 connected to the cooling path 11*a*. One end portion 14*a* of the cover 14 is supported by the case 11 while the other end portion 14*b* of the cover 14 is coupled to the lower portion of the case 11 by a screw 16 which is a coupling member.

In the blower unit 10 having the above structure, some of cooling air blown by the blower wheel 12 is input to the blow path 15 through the cooling path 11*a*. The cooling air input to the blow path 15 is supplied to the lower portion of the blower motor 13 to cool the blower motor 13.

However, since the cover 14 is coupled to the case 11 using the screw 16 which is an additional coupling member, the coupling of the cover 14 to the case 11 is complicated so that a manufacturing cost is raised.

FIG. 2 is a sectional view illustrating another conventional blower unit which is disclosed in Japanese Utility Model Publication No. hei 7-28707. Referring to the drawing, a conventional blower unit 20 includes a blower case 21, a blower chamber 22 having a scroll shape installed in the blower case 21, a concentric fan 26 installed in the blower chamber 22 to absorb internal air or external air, and a fan motor 27 accommodated in a lower portion of the blower case 21 to drive the concentric fan 26. An air outlet 23 is formed at one side of the blower case 21. Although not shown, an evaporator and a heater core are installed at the downstream of the air outlet 23.

A blow path 25 is formed as a blow path member 24 is coupled to one side of the lower portion of the blower case 21. The blow path 25 connects the inside of the blower chamber 22 and a lower portion of the fan motor 27.

According to the blower unit 20 having the above structure, some of cooling air blown by the concentric fan 26 is input to the blow path 25 from the inside of the blower chamber 22. The cooling air input to the blow path 25 is supplied to the lower portion of the fan motor 27 to cool the fan motor 27.

However, in the conventional blower unit 20, both ends 24*a* and 24*b* of the blow path member 24 which are approximately perpendicular to each other are coupled by being inserted in the blower case 21. Thus, the assembly of the blower unit 20 is complicated so that productivity is lowered.

In particular, since both ends 24*a* and 24*b* of the blow path member 24 are coupled to the case 21 along both directions which are approximately perpendicular to each other, automation of the assembly of the blow path member 24 with respect to the blower case 21 is practically very difficult.

SUMMARY OF THE INVENTION

To solve the above and other problems, the present invention provides a blower unit for an air conditioner having an improved structure by that the assembly of a cover forming a path for cooling air to cool a blower motor is improved and the assembly thereof can be automated.

According to an aspect of the present invention, a blower unit for an air conditioner comprising a case accommodating a blower wheel and a blower motor driving the blower wheel, a cover coupled to one side of a lower portion of the case to form a cooling path so that some of cooling air blown by the blower wheel is input to the cooling path and flows in the cooling path toward a lower portion of the blower motor, and a coupling unit detachably coupling the cover and the case by sliding the cover in one direction with respect to the case.

A cooling air guide path guiding some of the cooling air blown by the blower wheel to the cooling path is formed at one side in the case.

The blower unit further comprises a fixing unit preventing the cover from moving up and down with respect to the case when the cover is sliding coupled to the case.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION OF THE INVENTION

Figure 1:
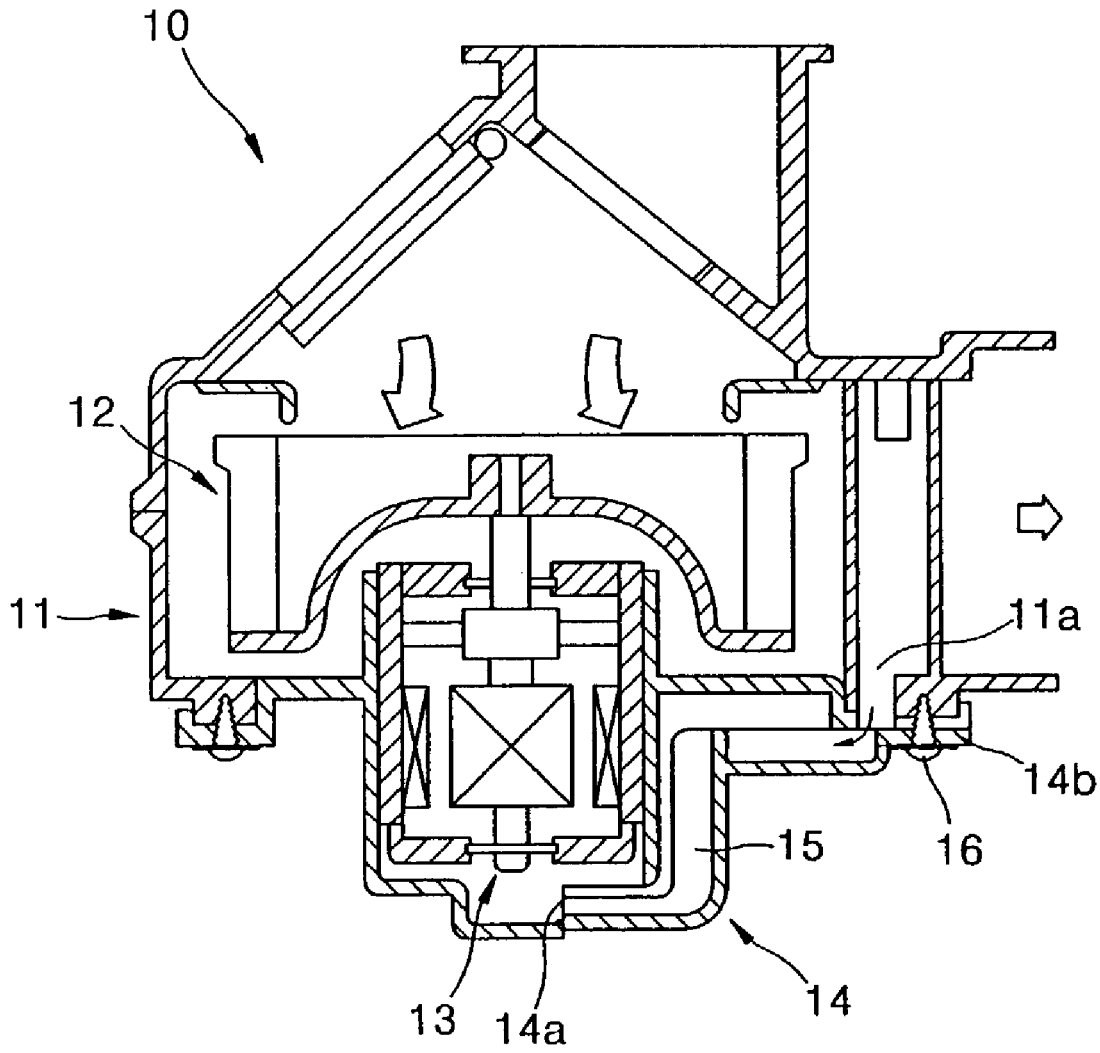
FIG. 1 (PRIOR ART)
FIG. 1 is a sectional view illustrating a conventional blower unit.
Figure 2:
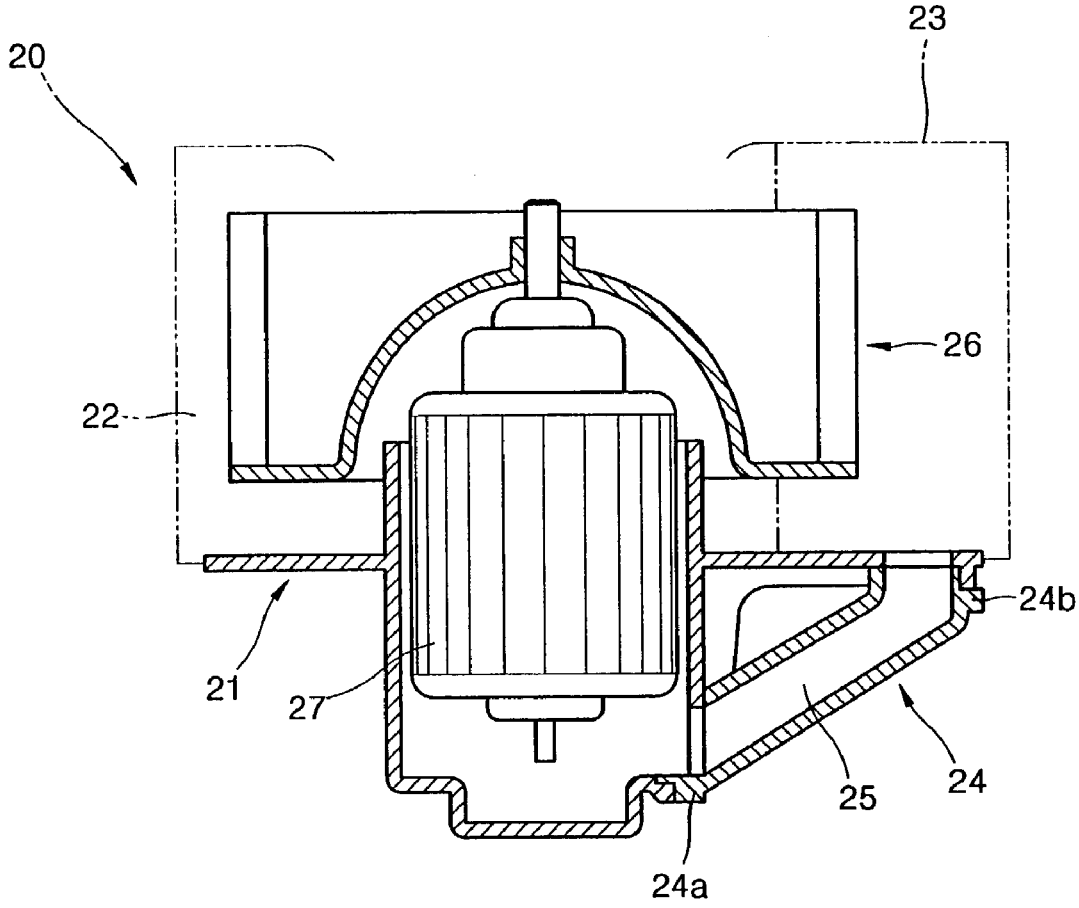
FIG. 2 (PRIOR ART)
FIG. 2 is a sectional view illustrating another conventional blower unit.
Figure 3:
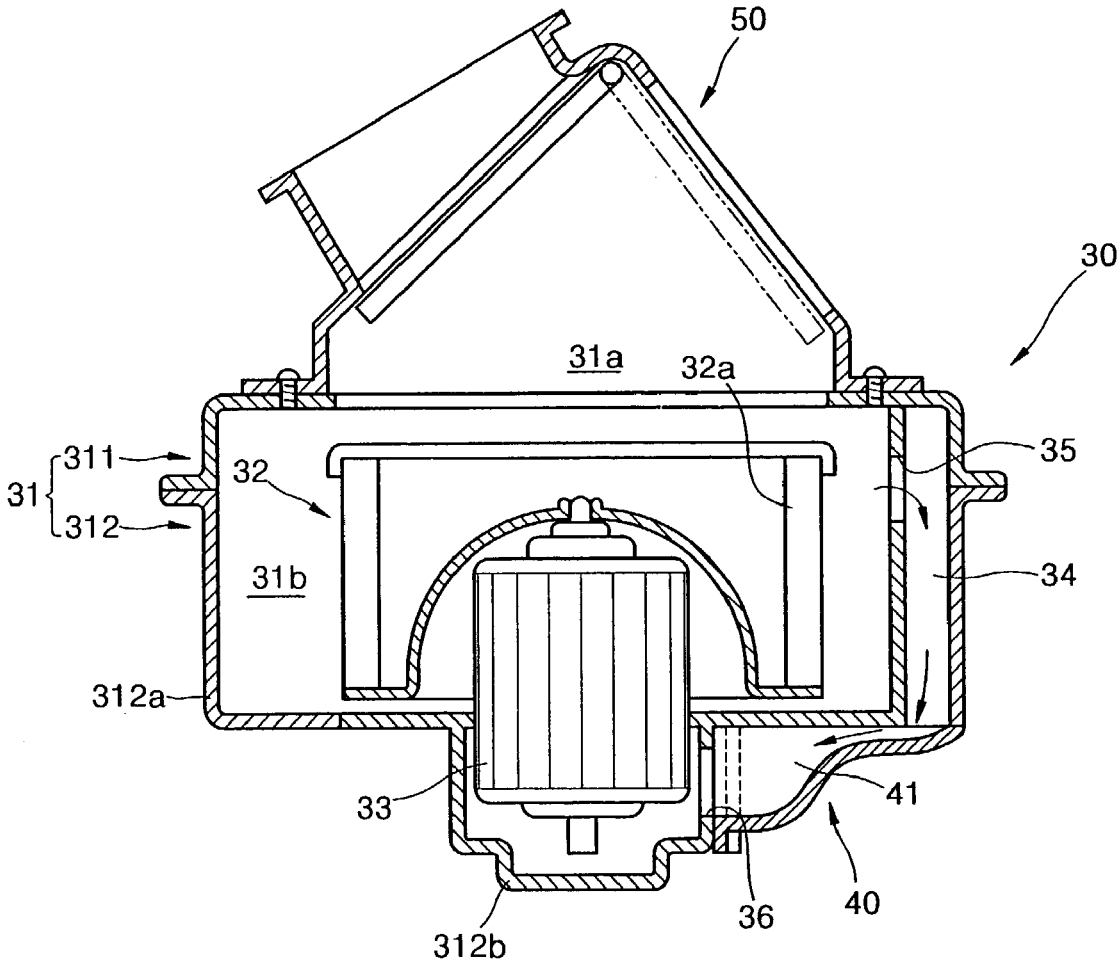
FIG. 3 is a section view illustrating a blower unit according to a preferred embodiment of the present invention.
Figure 4:
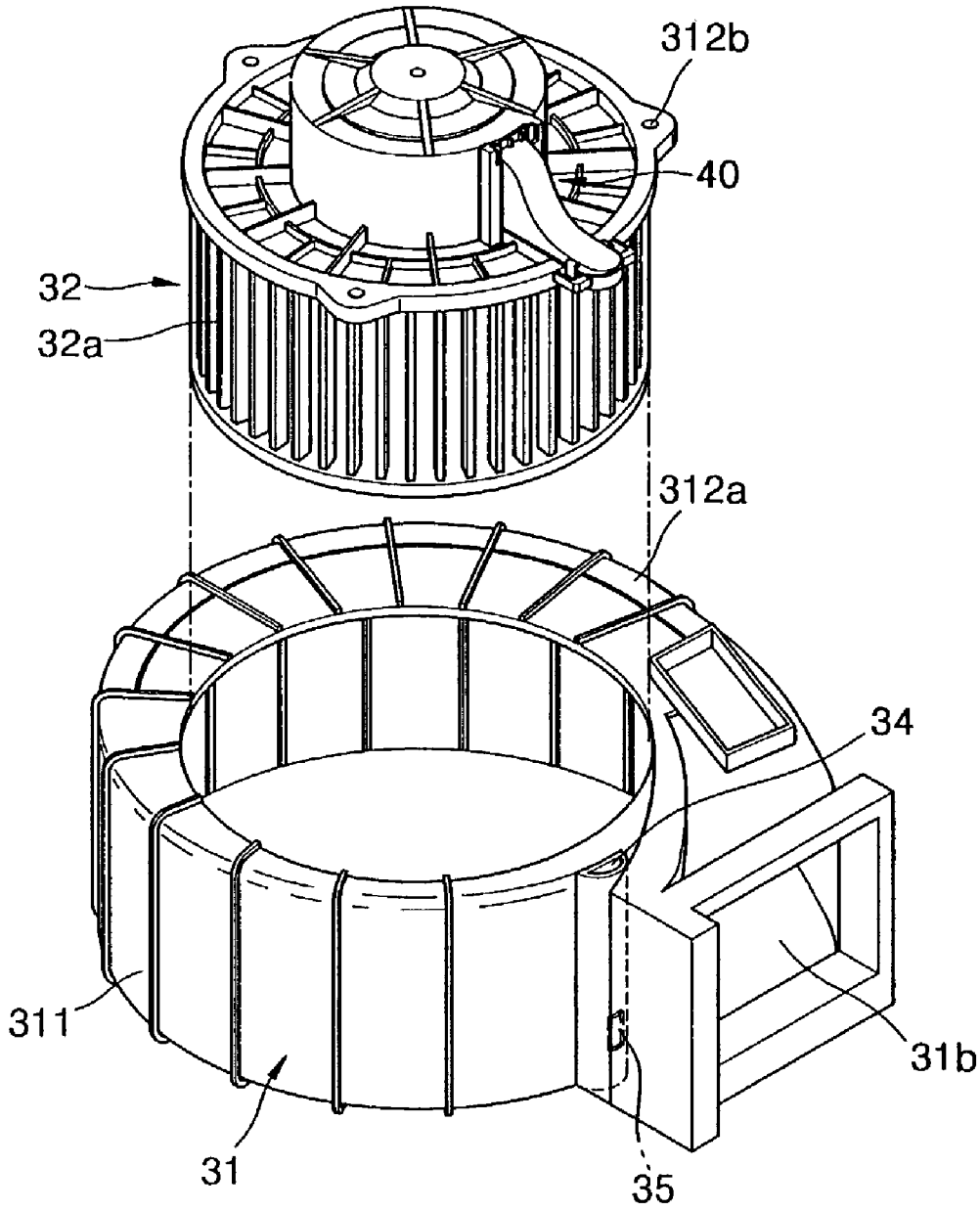
FIG. 4 is an exploded perspective view illustrating the blower unit shown in FIG. 3.

Referring to FIGS. 3 and 4, a blower unit 30 includes a blower wheel 32, a blower motor 33 driving the blower wheel 32, and a case 31 accommodating the blower wheel 32 and the blower motor 33.

The case 31 may include an upper case 311 and a lower case 312. The lower case 312 includes a main body portion 312*a* coupled to the upper case 311 and a housing portion 312*b* coupled to a lower surface of the main body portion 312*a* and forming a space for accommodating the blower motor 33. An inlet 31*a* for absorbing internal and/or external air from an intake case 50 is formed in the upper portion of the case 31, that is, the upper case 311. An outlet 31*b* for exhausting the absorbed air is formed between the case 31 and the blower wheel 32. A cooling air inlet 36 partially opening the blower motor 33 is formed in the lower portion of the case 31, that is, at one side of the housing portion 312*b* of the lower case 312. The blower wheel 32 includes a plurality of blades 32*a* inclined at a predetermined angle along the outer circumferential surface. The blower motor 33 is installed in the space formed in the housing portion 312*b* of the lower case 312.

In the meantime, since the blower motor 33 driving the blower wheel 32 generates heat during its operation, the blower motor 33 must be cooled to prevent overheat. For this purpose, a cover 40 is coupled to the lower portion of the case 31, that is, one side of the housing portion 312*b* of the lower case 312 so as to form a cooling path 41 through which some of the cooling air blown by the blower wheel 32 can flow to a lower portion of the blower motor.

As shown in FIGS. 3 and 4, a cooling air guide path 34 for guiding some of the cooling air blown by the blower wheel 32 toward the cooling path 41 may be formed at one side inside the case 31. Thus, some of the cooling air blown by the blower wheel 32 is guided toward the cooling air guide path 34 through a cooling air guide opening 35 and input to the cooling path 41 so that the cooling air can be supplied to the lower portion of the blower motor 33.

In the preferred embodiment of the present invention having the above structure, to improve the assembly feature of the cover 40 coupled to the case 31, the cover 40 is detachably coupled to the case 31, that is, the lower case 312, by sliding in one direction by a coupling unit to be described later.

Figure 5:
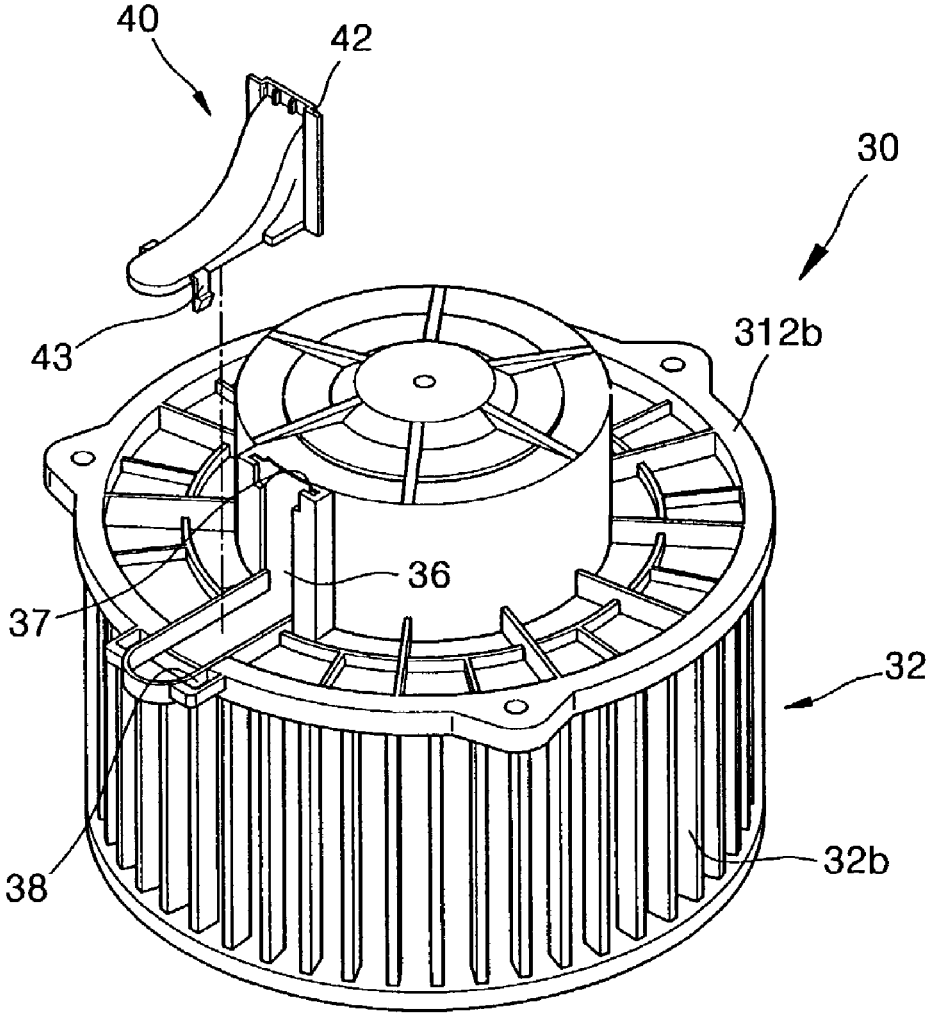
FIG. 5 is an exploded perspective view illustrating the case and the cover shown in FIG. 3.
Figure 6:
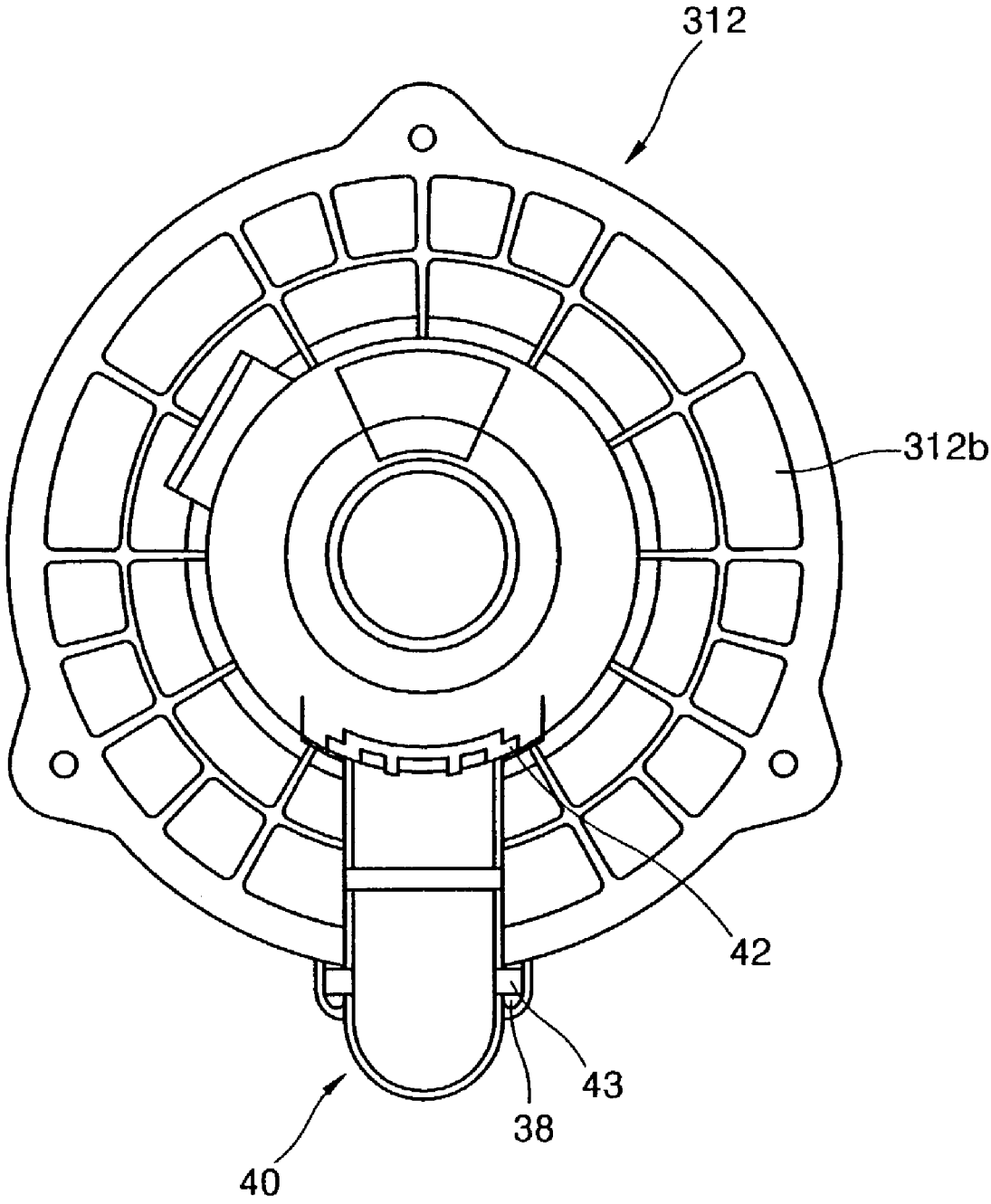
FIG. 6 is a plan view illustrating the case and the cover shown in FIG. 5.
Figure 7:
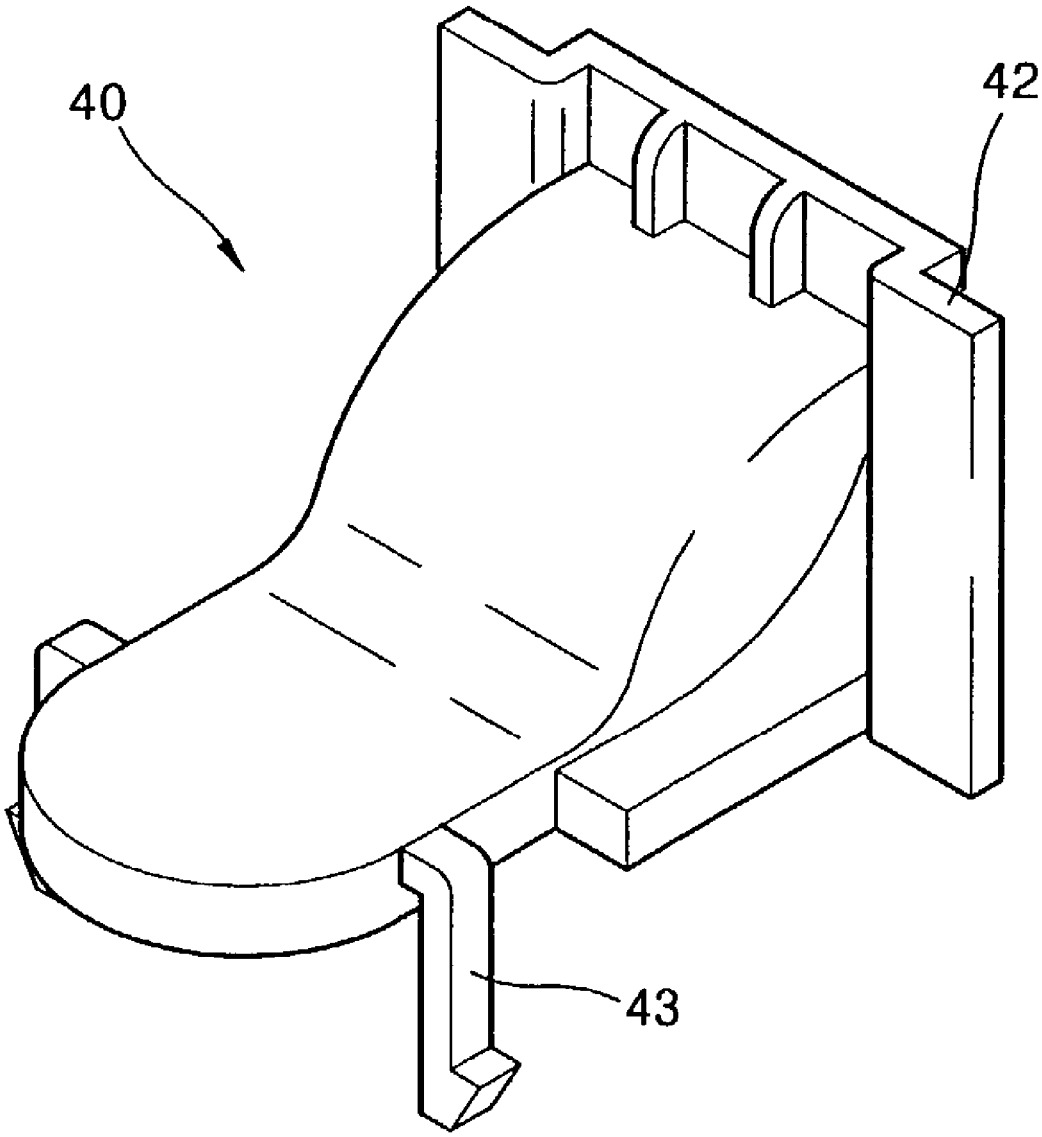
FIG. 7 is a perspective view illustrating the cover shown in FIG. 5.
Figure 8:
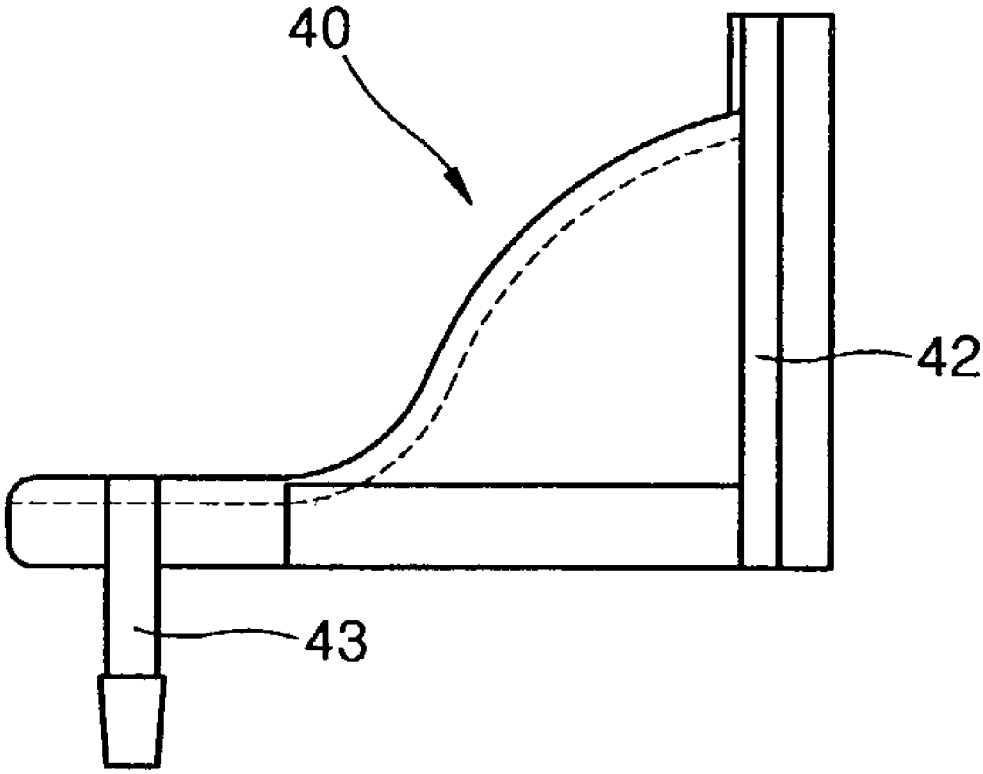
FIG. 8 is a front view illustrating the case and the cover shown in FIG. 5.

FIG. 5 is an exploded perspective view illustrating the case and the cover shown in FIG. 3. FIG. 6 is a plan view illustrating the case and the cover shown in FIG. 5. FIG. 7 is a perspective view illustrating the cover shown in FIG. 5. FIG. 8 is a front view illustrating the case and the cover shown in FIG. 5. Here, the same reference numerals as those shown in FIGS. 3 and 4 indicate the same members having the same structure and function.

Referring to the drawings, the coupling unit includes a guide rib 42 arranged at one end portion of the cover 40 and a guide groove 37 formed at the cooling air inlet 36 and an adjacent portion corresponding to the guide rib 42. The guide rib 42 is sliding coupled to the guide groove 37 by being inserted therein. For this coupling, the guide groove 37 has a width and shape corresponding to those of the guide rib 42. As the guide rib 42 is sliding coupled to the guide groove 37, the cover 40 is prevented from moving back and forth with respect to the case 31.

Figure 9:
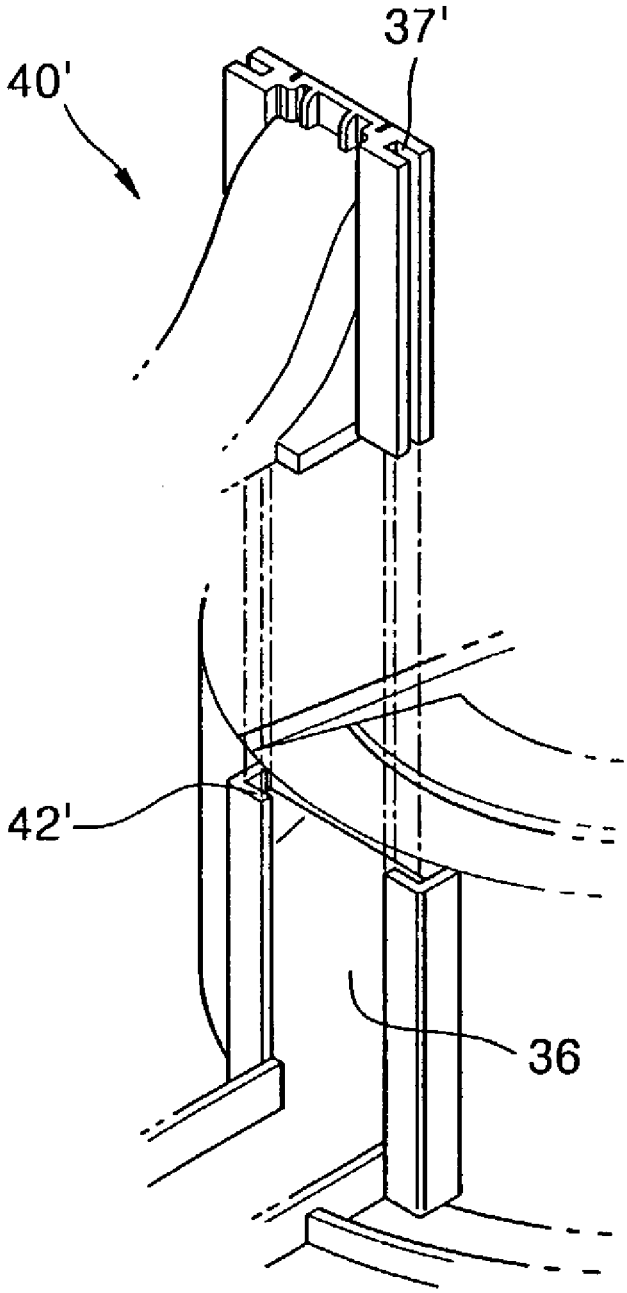
FIG. 9 is an exploded perspective view illustrating a coupling unit of the case and the cover of the blower unit according to another preferred embodiment of the present invention.

Alternatively, as shown in FIG. 9, a guide rib 42' is arranged at apportion adjacent to the cooling air inlet 36 while a guide groove 37' corresponding to the guide rib 42' can be formed at one end portion of a cover 40'. That is, the positions of the guide ribs 42 and 42' and the guides grooves 37 and 37' can be changed each other. In any event, the guide ribs 42 and 42' and the guide grooves 37 and 37' are sliding coupled.

As described above, when the covers 40 and 40' and the case 31 are coupled, since the covers 40 and 40' slide in one direction with respect to the case 31, the coupling work thereof is simplified and the coupling work can be automated.

In the meantime, as shown in FIGS. 5 through 8, the blower unit 30 according to the present invention may further include a fixing unit to prevent the cover 40 from moving up and down with respect to a lower portion of the case 31, that is, the housing portion 312*b* of the lower case 312, when the cover 40 is sliding coupled to the case 31.

The fixing unit may includes at least one hook 43 arranged at a side portion of the cover 40 and at least one insertion groove 38 formed in the lower portion of the case, that is, at an outer circumferential surface of the housing portion 312*b* of the lower case 312, to correspond to the hook 43. The hook 43 is fixed by being inserted in the insertion groove 38. Accordingly, since the hook 43 is inserted in the insertion groove 38 and fixed thereto, the cover 40 can be prevented from moving up and down with respect to the case 31.

Figure 10:
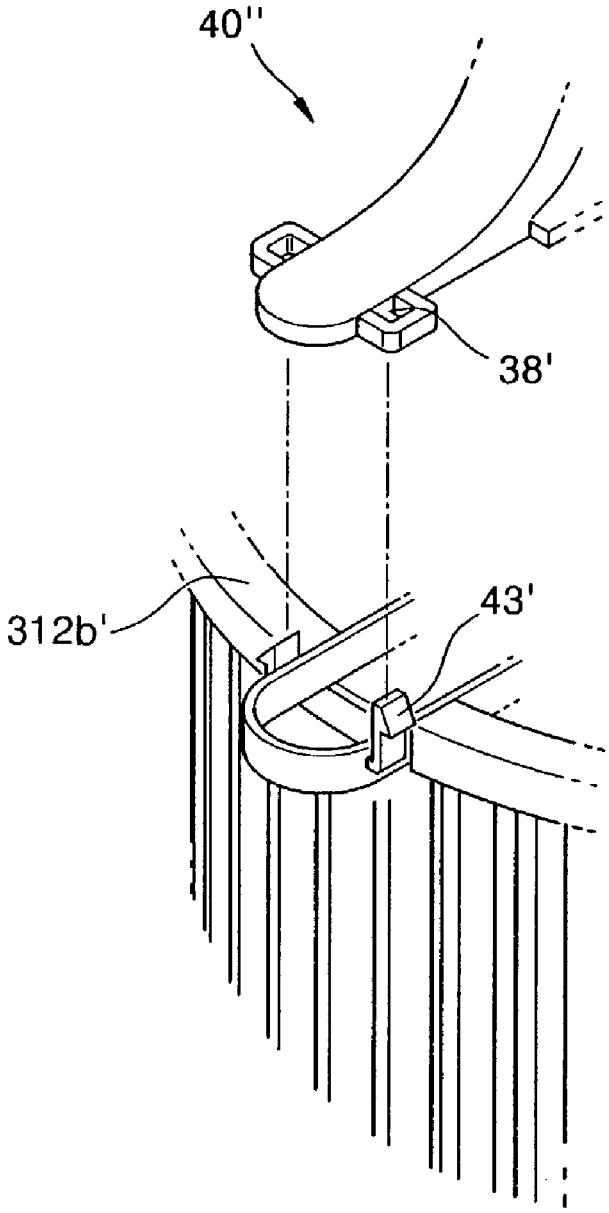
FIG. 10 is an exploded perspective view illustrating a fixing unit of the case and the cover of the blower unit according to another preferred embodiment of the present invention.

Alternatively, as shown in FIG. 10, at least one hook 43' is arranged at an outer circumferential surface of the housing portion 312*b'* of the lower case 312 while at least one insertion groove 38' may be formed at a side portion of a cover 40" to correspond to the hook 43'. That is, although the positions of the hooks 43 and 43' and the positions of the insertion grooves 38 and 38' can be changed each other, the hook 43' is inserted in the insertion groove 38' and fixed thereto in any event.

In the operation of cooling of the blower motor 33 according to the preferred embodiment of the present invention, when the blower motor 33 rotates, the blower wheel 32 connected to the blower motor 33 rotates. The cooling air generated by a rotation force of the blower wheel 32 blows air toward the evaporator and the heater core which are not shown.

Some of the cooling air blown by the blower wheel 32 flows by being guided to the cooling air guide path 34 formed at one side of the case 31. The cooling air flowing in the cooling air guide path 34 is input to the cooling path 41 connected to the cooling air guide path 34. The cooling air flowing in the cooling path 41 is supplied to the lower portion of the blower motor 33 through the cooling air inlet 36. The cooling air supplied to the lower portion of the blower motor 33 through the cooling air inlet 36. The cooling air supplied to the lower portion of the blower motor 33 cools the blower motor 33 which is heated during operation.

According to the blower unit 30 for an air conditioner according to the present invention, as the covers 40, 40', and 40" slide in one direction with respect to the case 31, the covers 40, 40', and 40" is detachably coupled to the case 31 so that a coupling work thereof is simplified and an additional coupling member for coupling of the covers 40, 40', and 40" is not needed, thus reducing a manufacturing cost. In particular, since the covers 40, 40', and 40" are sliding coupled to the case 31 in one direction, automation is possible. By the sliding coupling of the guide ribs 42 and 42' and the guide groves 37 and 37', the covers 40, 40', and 40" can be prevented from moving back and forth with respect to the case 31.

Furthermore, since the hooks 43 and 43' are inserted in the insertion grooves 38 and 38' and fixed thereto, the covers 40, 40', and 40" can be prevented from moving up and down with respect to the case 31.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A blower unit for an air conditioner, comprising:

a case accommodating a blower wheel and a blower motor driving the blower wheel;

a cover coupled to one side of a lower portion of the case to form a cooling path so that some of cooling air blown by the blower wheel is input to the cooling path and flows in the cooling path toward a lower portion of the blower motor; and a coupling unit detachably coupling the cover and the case by sliding the cover in one direction with respect to the case;

wherein the coupling unit comprises a guide rib arranged at one end portion of the cover and a guide groove formed to correspond to the guide rib at a portion adjacent to a cooling air inlet into which the cooling air is input to the lower portion of the blower motor from the cooling path, and the guide rib is slidingly coupled to the guide groove.

2. The blower unit as claimed in claim 1, further comprising a cooling air guide path through which some of the cooling air blown by the blower wheel is guided to the cooling path, wherein the cooling air guide path is formed at one side in the case.

3. The blower unit as claimed in claim 1, further comprising a fixing unit preventing the cover from moving up and down with respect to the case when the cover is slidingly coupled to the case.

4. The blower unit as claimed in claim 3, wherein the fixing unit comprises at least one hook arranged at a side portion of the cover and at least one insertion groove formed at an outer circumferential surface of the lower portion of the case to correspond to the hook, and the hook is fixed by being inserted in the insertion groove.

5. The blower unit as claimed in claim 3, wherein the fixing unit comprises at least one hook arranged at an outer circumferential surface of the lower portion of the case and at least one insertion groove formed at a side portion of the cover to correspond to the hook, and the hook is fixed by being inserted in the insertion groove.

6. A blower unit for an air conditioner, comprising:

a case accommodating a blower wheel and a blower motor driving the blower wheel;

a cover coupled to one side of a lower portion of the case to form a cooling path so that some of cooling air blown by the blower wheel is input to the cooling path and flows in the cooling path toward a lower portion of the blower motor; and a coupling unit detachably coupling the cover and the case by sliding the cover in one direction with respect to the case;

wherein the coupling unit comprises a guide rib arranged at a portion adjacent to an cooling air inlet through which the cooling air is input to the lower portion of the blower motor from the cooling path and a guide groove formed to correspond to the guide rib at one end portion of the cover, and the guide rib is slidingly coupled to the guide groove.

7. The blower unit as claimed in claim 6, further comprising a fixing unit preventing the cover from moving up and down with respect to the case when the cover is slidingly coupled to the case.

8. The blower unit as claimed in claim 7, wherein the fixing unit comprises at least one hook arranged at a side portion of the cover and at least one insertion groove formed at an outer circumferential surface of the lower portion of the case to correspond to the hook, and the hook is fixed by being inserted in the insertion groove.

9. The blower unit as claimed in claim 7, wherein the fixing unit comprises at least one hook arranged at an outer circumferential surface of the lower portion of the case and at least one insertion groove formed at a side portion of the cover to correspond to the hook, and the hook is fixed by being inserted in the insertion groove.

* * * * *